United States Patent [19]

McLaughlin

[11] Patent Number: 4,542,594

[45] Date of Patent: Sep. 24, 1985

[54] APPARATUS FOR REMOVING WATER FROM THE GROUND

[76] Inventor: Hugh R. McLaughlin, Aberdour, Bray Rd., Foxrock, Dublin 18, Ireland

[21] Appl. No.: 585,083

[22] Filed: Mar. 1, 1984

[30] Foreign Application Priority Data

Mar. 16, 1983 [IE] Ireland ..... 576/83
Jun. 3, 1983 [IE] Ireland ..... 1324/83

[51] Int. Cl.[4] ..... E01H 1/00

[52] U.S. Cl. ..... 34/71; 34/95; 34/95.3; 15/98; 15/119 A

[58] Field of Search ..... 34/71, 95, 95.3; 15/98, 15/119 A

[56] References Cited

U.S. PATENT DOCUMENTS 3,079,620 3/1963 Hunter ..... 34/95
3,950,812 4/1976 Mohr ..... 15/98
4,445,247 5/1984 Johannessen ..... 15/119 A

FOREIGN PATENT DOCUMENTS 31112 12/1980 European Pat. Off. .
3036505 5/1982 Fed. Rep. of Germany .
459281 9/1968 Switzerland .

*Primary Examiner*—Larry I. Schwartz

*Assistant Examiner*—David W. Westphal

*Attorney, Agent, or Firm*—Sughrue, Mion, Zinn, Macpeak and Seas

[57] ABSTRACT

An apparatus for the removal of water from the ground comprises at least one ground-engaging drum including a hollow cylinder mounted for rotation about a horizontal axis, a plurality of apertures distributed around the circumference of the cylinder, and a layer of open cell resilient material covering the outer surface of the cylinder. Valves in the drum are arranged to close the apertures except under the inward pressure of water passing through the resilient layer when the latter is compressed, and a plurality of troughs are provided on the inner surface of the cylinder for carrying water which enters the apertures in the area of ground contact upwardly away from the ground by rotation of the cylinder. A non-rotating water tank (not shown) mounted within the cylinder collects the water discharged from the troughs when each reaches a certain height. In a further embodiment the layer includes funnel-shaped apertures which communicate directly with respective apertures in the cylinder and the outer surface of the layer is covered with a non-porous rubber sheet except at the entrance to the apertures in the layer. In this case the resilient layer may not be of open cell structure.

16 Claims, 14 Drawing Figures

APPARATUS FOR REMOVING WATER FROM THE GROUND

This invention concerns an apparatus for the removal of surface water and limited sub-surface water from the ground, the floor or the like surfaces hereinafter referred to collectively as the ground. For example the apparatus is adapted to remove water from sports fields including football pitches, athletic grounds, cricket grounds, bowling greens, race tracks, golf courses and is particularly suitable for use with grass covered surfaces. Sporting events are frequently cancelled or abandoned due to water logging. Others are held in very soggy conditions to the disadvantage of the sport concerned both from the player's and spectator's points of view.

Plastic sheeting has been tried unsuccessfully as a method of protecting the ground but the main difficulty here has been removing the plastic sheeting, with the weight of water on it. Also of course, plastic sheeting cannot withstand even moderate winds without lifting and/or tearing. This is combined with the failure to find a satisfactory method of joining the sheets to avoid seepage at the joints.

Accordingly, the present invention provides an apparatus for the removal of water from the ground, characterised by a ground-engaging drum including a hollow cylinder mounted for rotation about a horizontal axis, a plurality of apertures distributed around the circumference of the cylinder and a layer of resilient material covering the outer surface of the cylinder, the resilient layer including means distributed around its circumference to permit the passage of water through the resilient layer to the cylinder, valve means in the drum arranged to close the apertures, at least in respect of the lower region of the drum, except under the inward pressure of water passing through the resilient layer when the latter is compressed, a plurality of troughs on the inner surface of the cylinder for carrying water which enters the apertures in the area of ground contact upwardly away from the ground by rotation of the cylinder, and a non-rotating water tank mounted within the cylinder for collecting water discharged from the troughs when each reaches a certain height.

The present invention has the advantage that there is no need to cover the ground to protect it from excessive rain, as the apparatus can traverse even the soggiest ground without injury to it whilst at the same time collecting the water as it travels, by both pressure and suction from the base of the grass, leaving it in a relatively dry condition.

Figure 1:
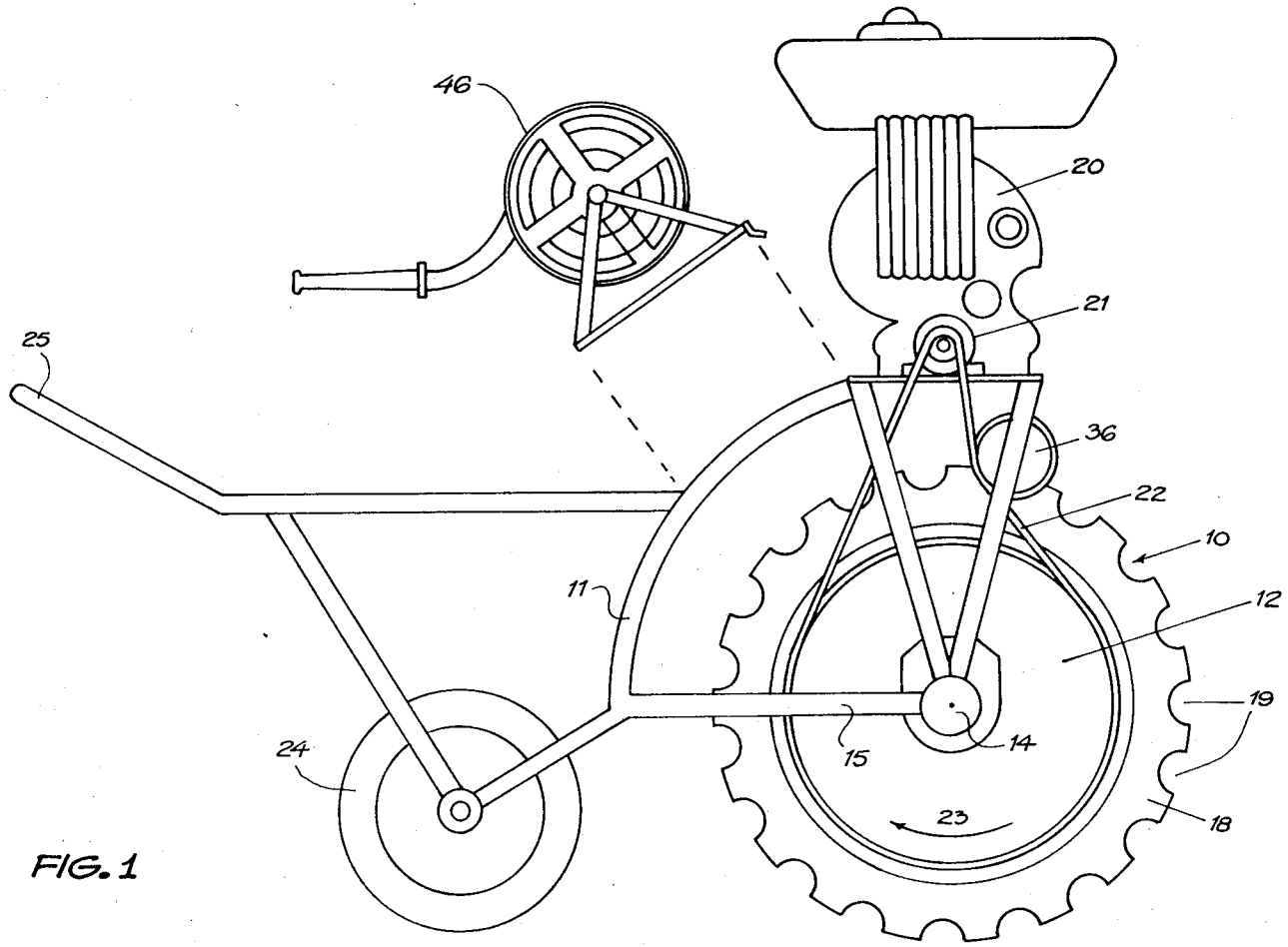
Figure 2:
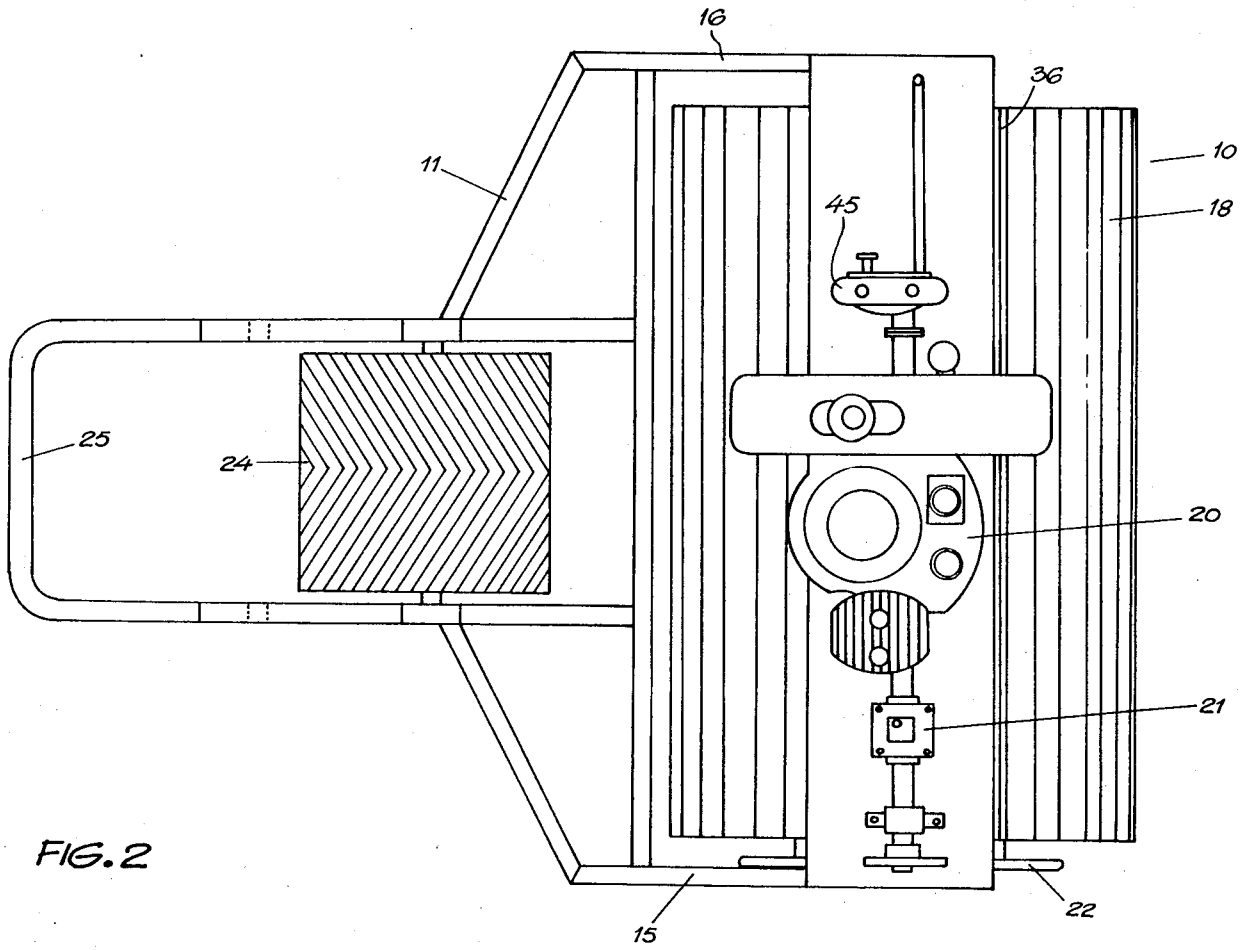
Figure 4:
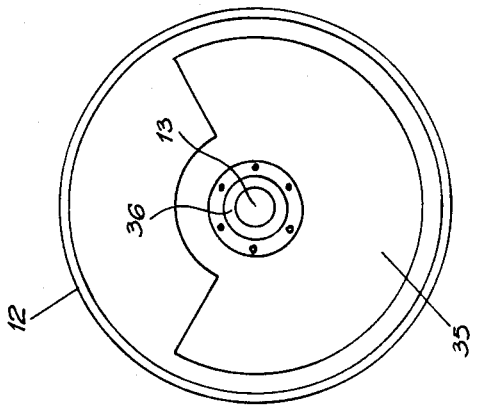
Figure 3:
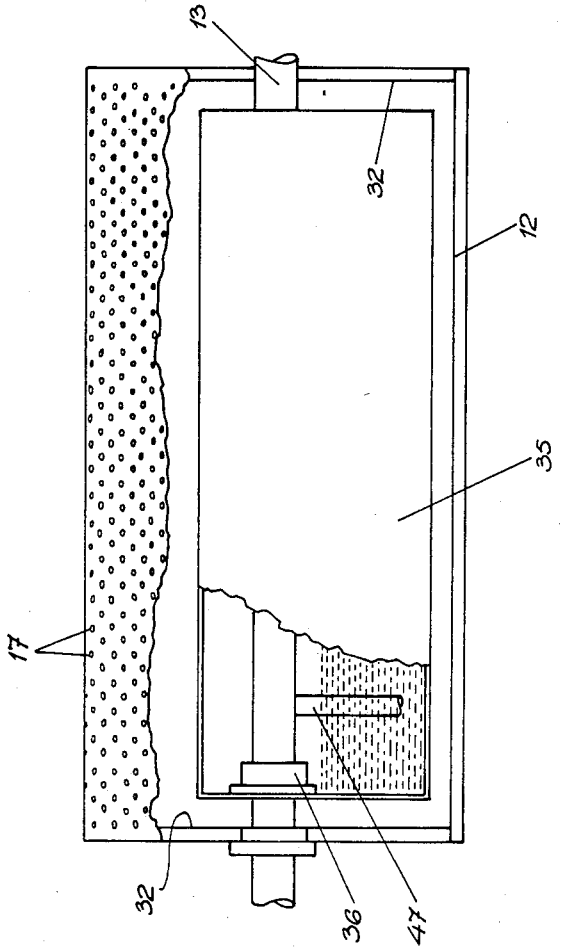
Figure 5:
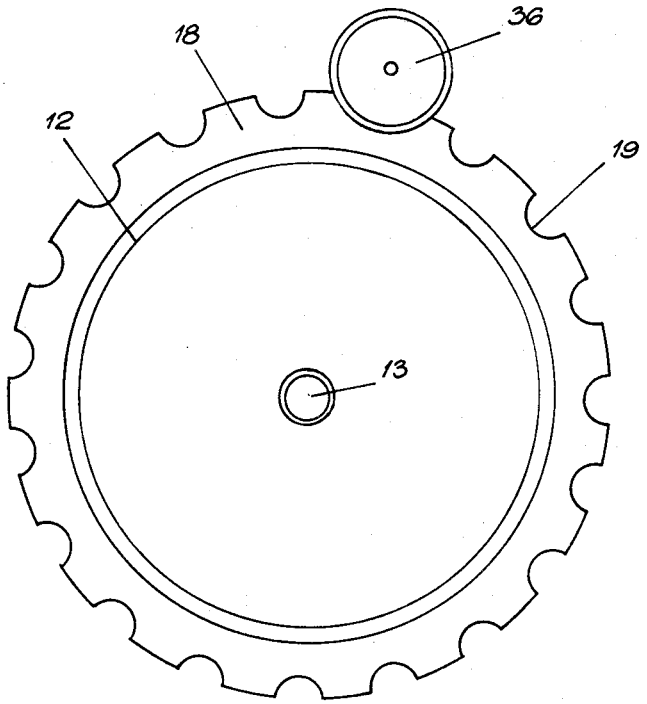
Figure 6:
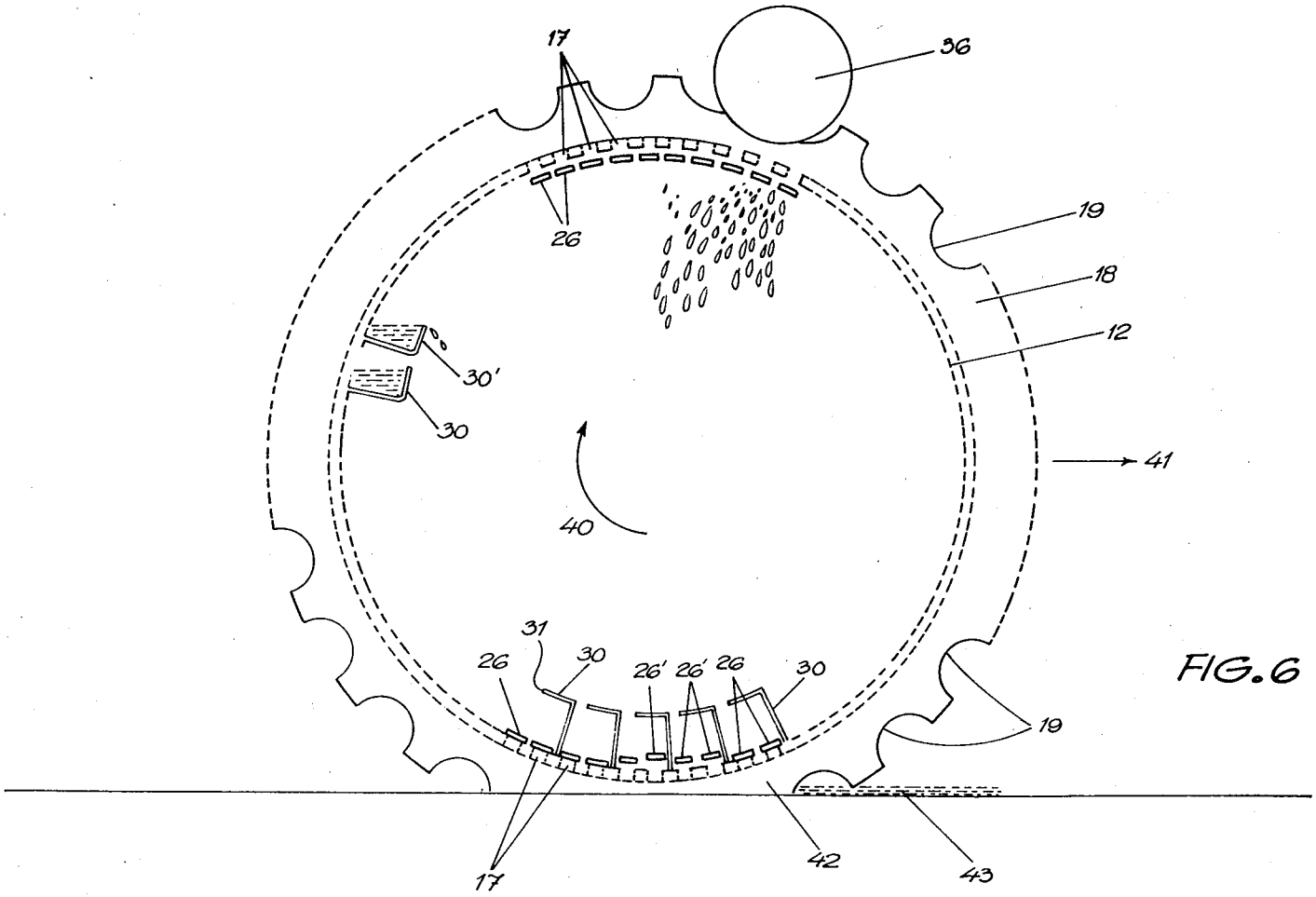

Embodiments of the invention will now be described, by way of example with reference to the accompanying drawings in which:

FIG. 1 is a side view of a first embodiment of an apparatus according to the invention, FIG. 2 is a top plan view of the apparatus of FIG. 1, FIG. 3 is a partially cut-away side view of the apertured cylinder and water tank forming part of the apparatus of FIG. 1, FIG. 4 is a cross-sectional view of FIG. 3, FIG. 5 is a cross-sectional view of the water-collecting drum and pressure roller forming part of the apparatus of FIG. 1, FIG. 6 is a more detailed cross-sectional view of the drum and pressure roller to illustrate the principle of operation.

Figure 7:
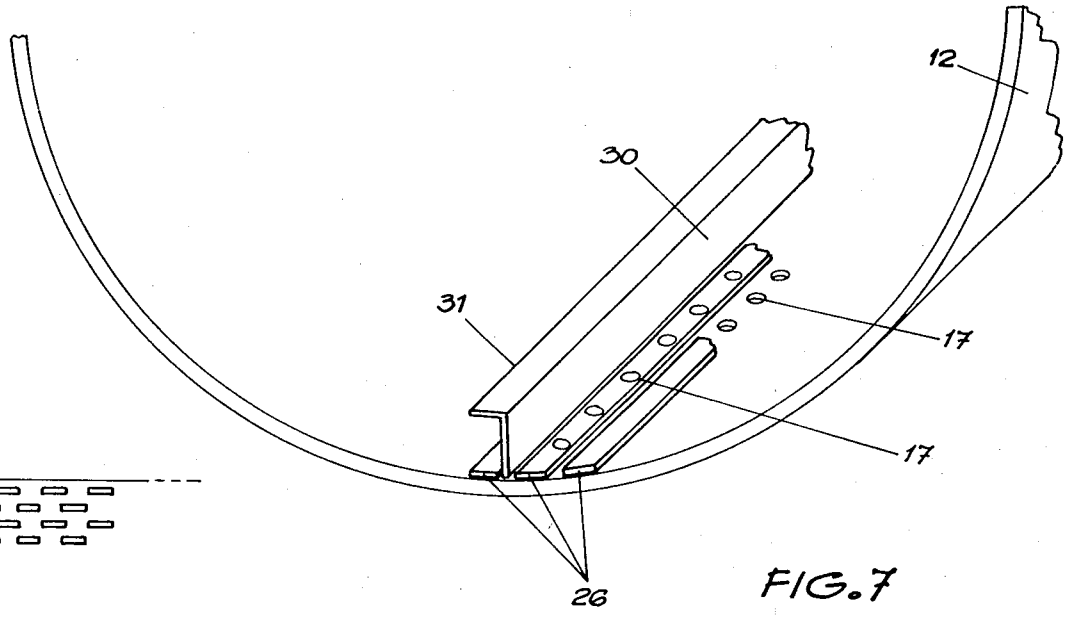
Figure 8:
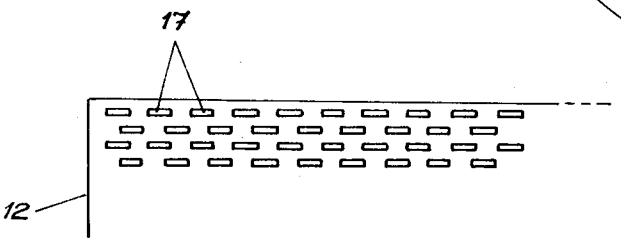
Figure 9:
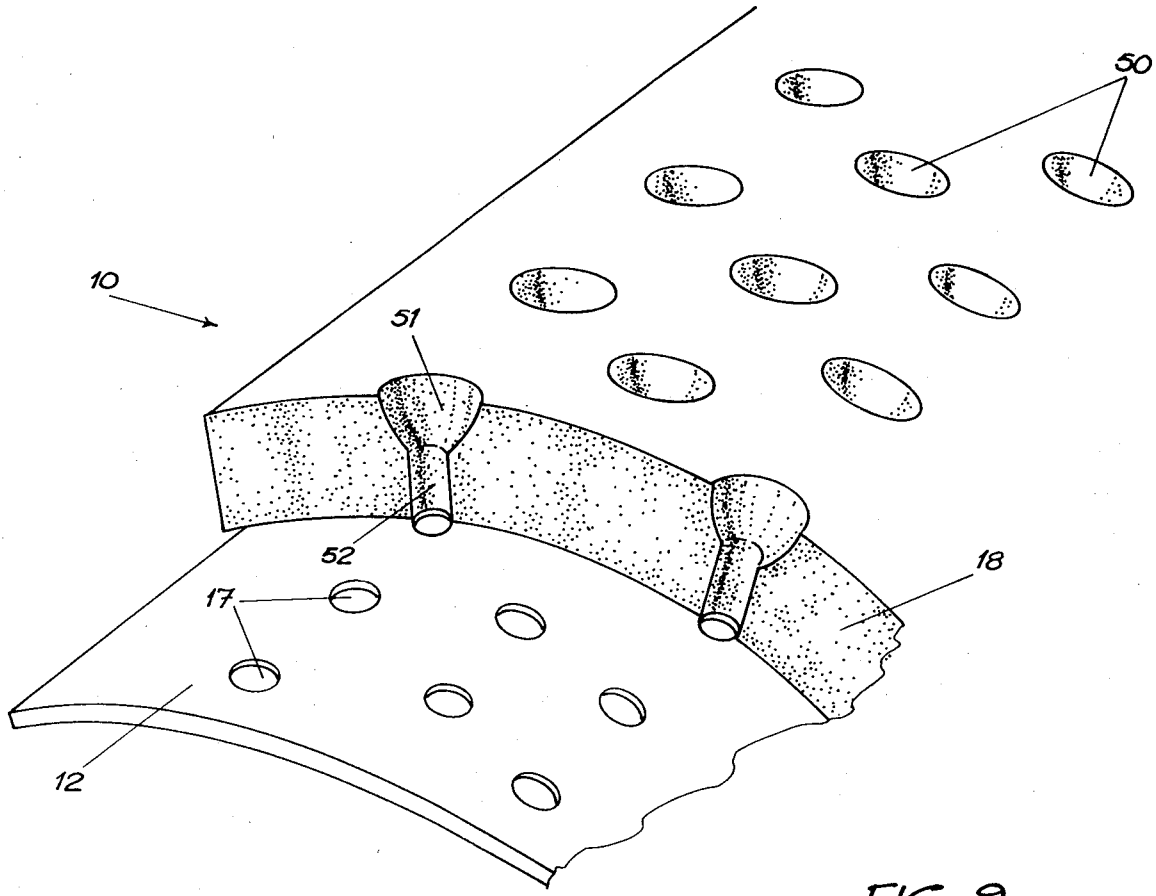
Figure 10:
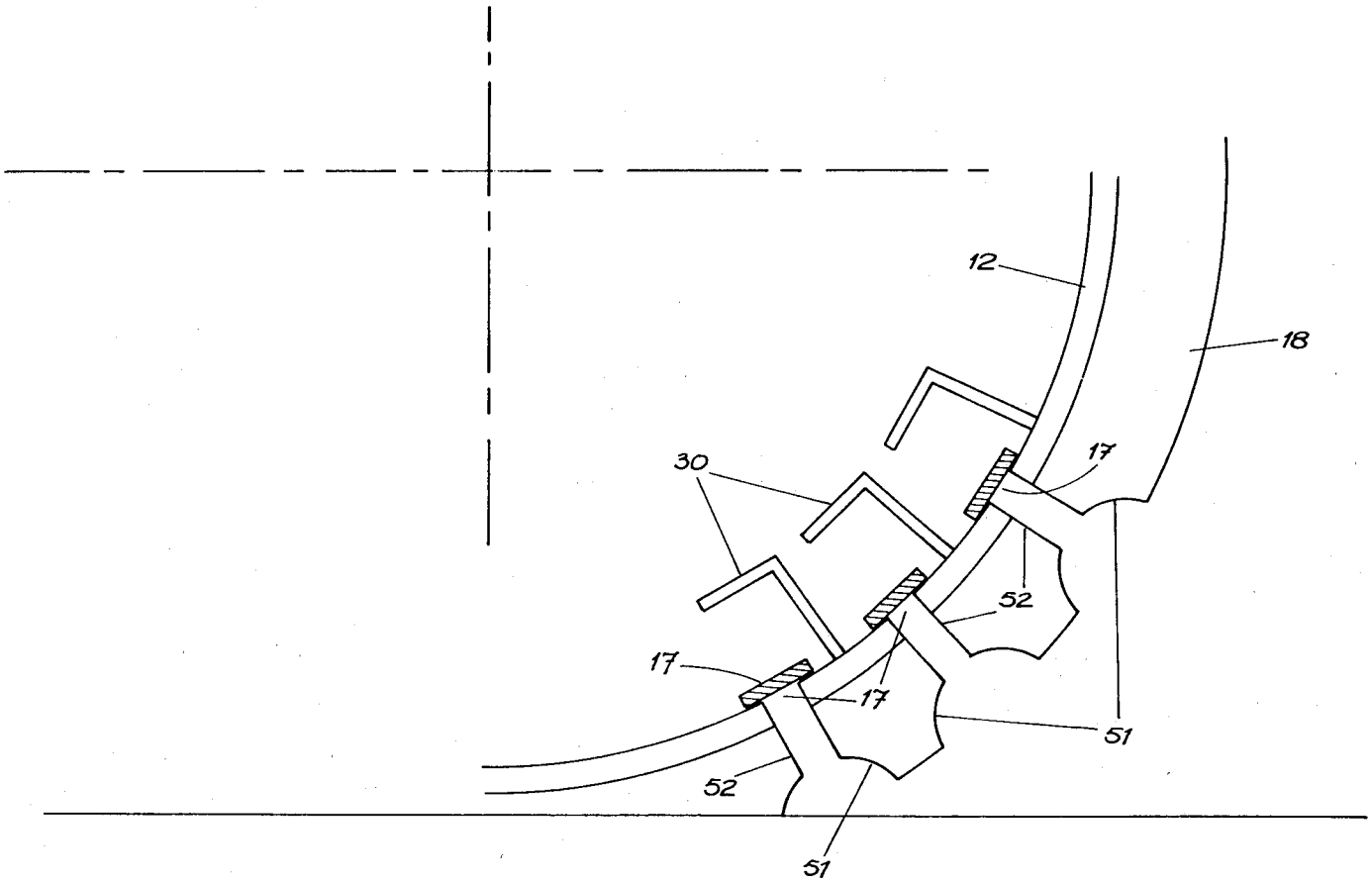
Figure 11:
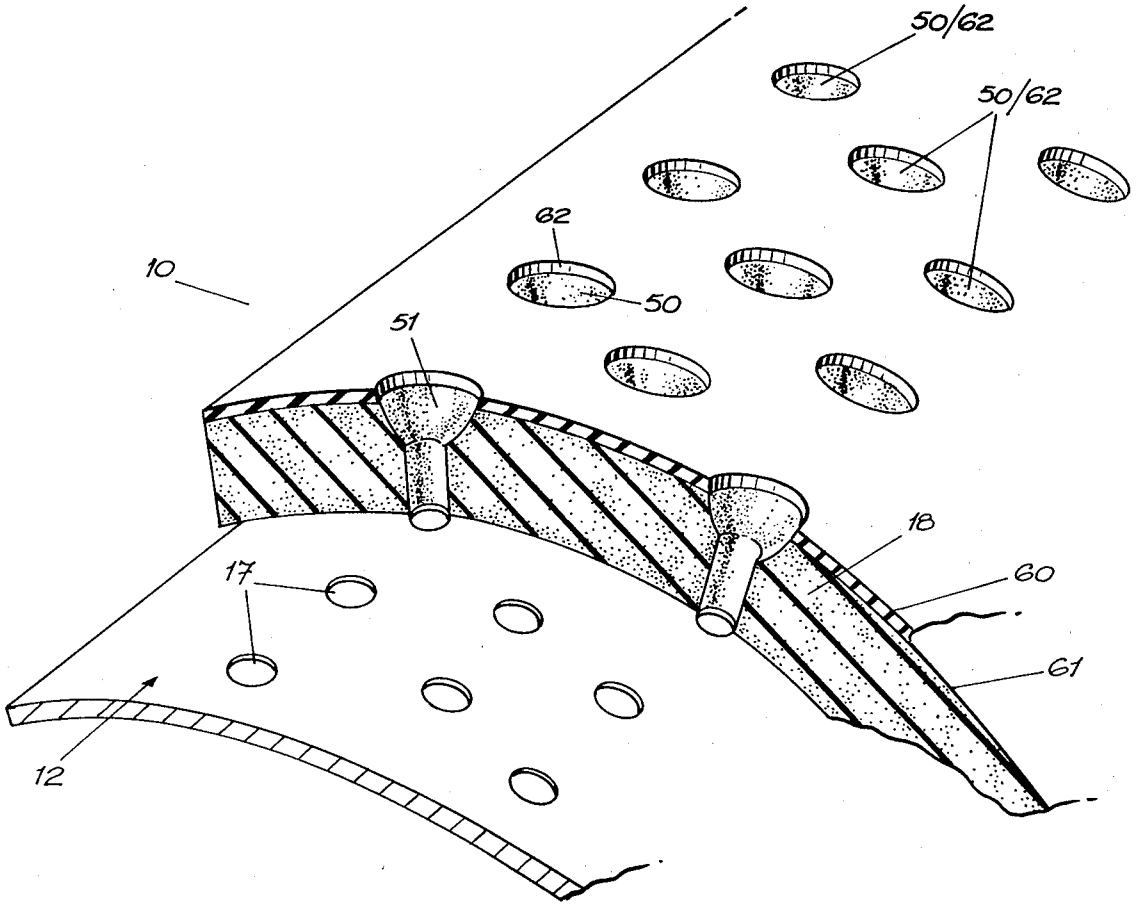
Figure 12:
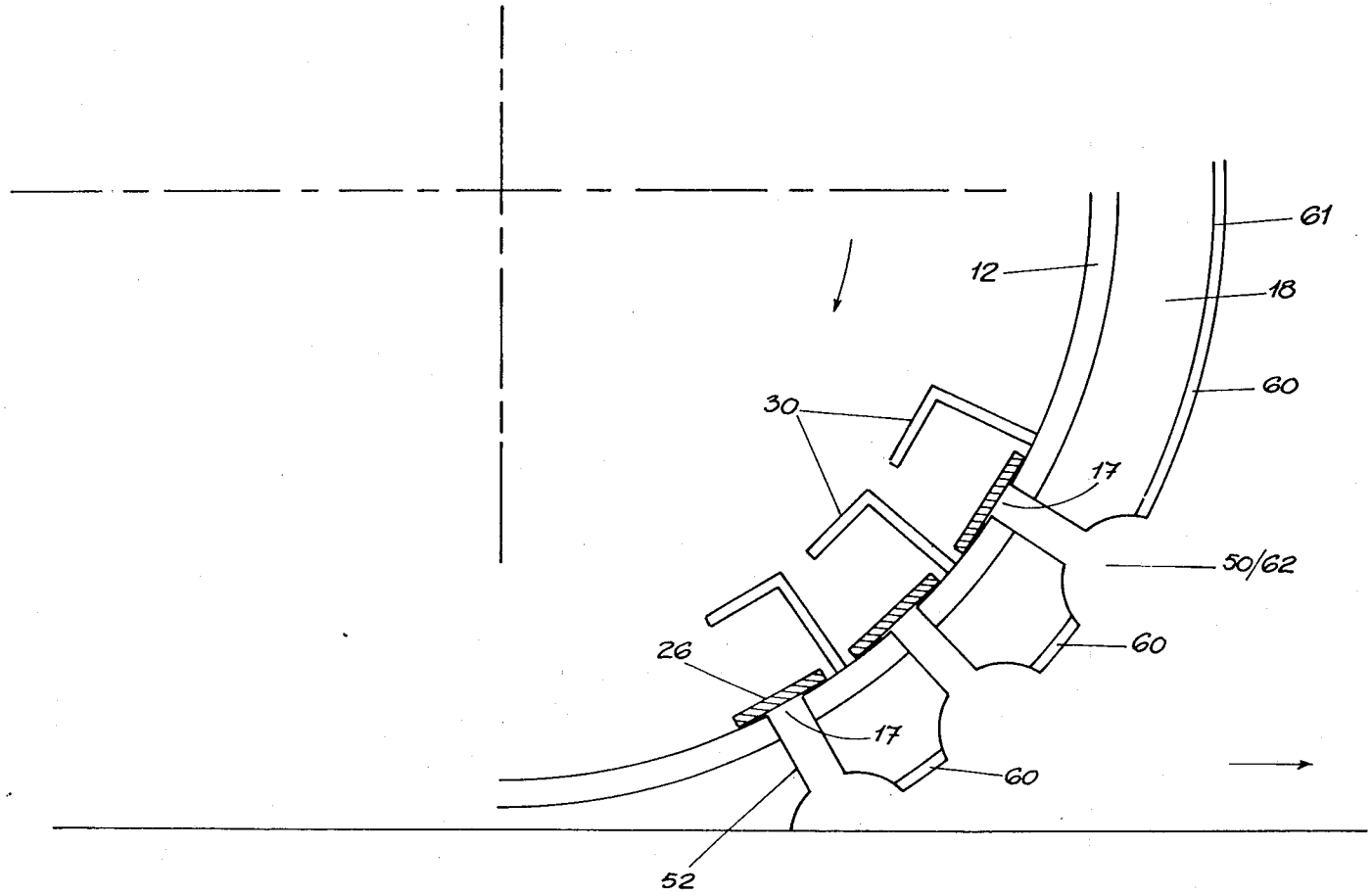
Figure 13:
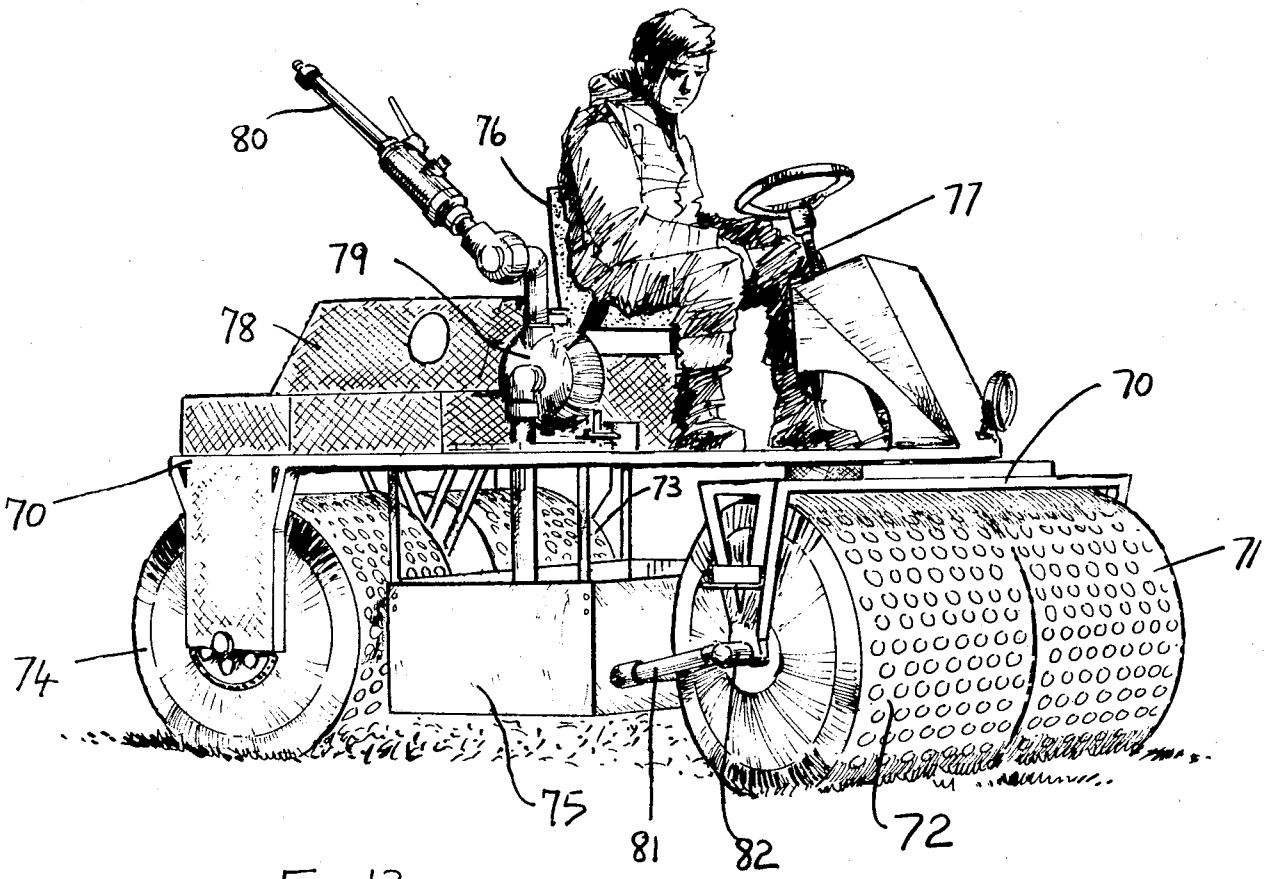
Figure 14:
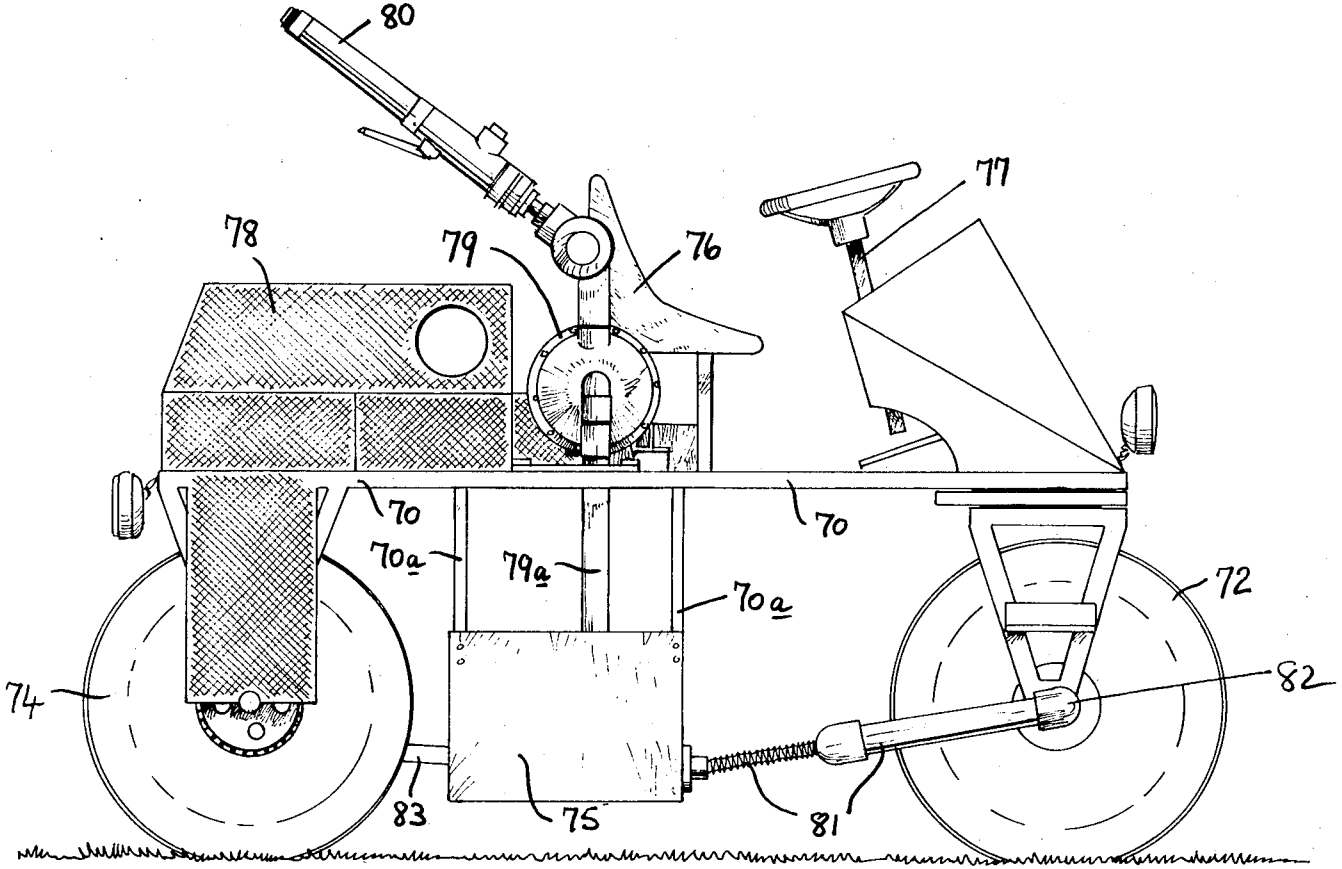

FIG. 7 is a partial perspective view of a trough and flap valves forming part of the drum of FIG. 6, FIG. 8 is an alternative arrangement for the apertures in the cylinder of FIG. 3, FIG. 9 is a cut-away perspective view of a portion of the ground engaging drum of a second embodiment of the invention, FIG. 10 is a cross-sectional view of the drum of FIG. 9, FIG. 11 is a cut-away perspective view of a portion of the ground engaging drum of a further embodiment of the invention, FIG. 12 is a cross-sectional view of the drum of FIG. 11, FIG. 13 is a perspective view of a fourth embodiment of an apparatus according to the invention, and FIG. 14 is a side view of the apparatus as illustrated in FIG. 13.

Referring to FIGS. 1 and 2 of the drawings, the apparatus comprises a ground-engaging drum 10 mounted in a frame 11 for rotation about a horizontal axis. More specifically, the drum 10 comprises an inner cylinder 12 of stainless steel or extruded PVC which is rotatably mounted on a fixed horizontal shaft 13, the latter passing coaxially through the cylinder 12 (FIG. 3) and being supported at each end in respective mountings 14 carried at opposite sides 15, 16 of the frame 11.

The cylinder 12 is apertured around its circumference, the apertures 17 either being circular as shown in FIGS. 3 and 7 or, more preferably, elongate slots as shown in FIG. 8. In either case the apertures 17 are arranged in rows which extend across the full width of the cylinder parallel to its axis of rotation, the rows being equally spaced around the circumference of the cylinder. The apertures 17 are staggered from one row to the next, each aperture of a given row being positioned intermediate a pair of apertures in the rows immediately on either side. In the case of slotted apertures, FIG. 8, these are aligned in the direction of their respective rows.

Finally, the drum 10 comprises an outer layer 18 of open cell foam rubber, preferably about two inches in depth, covering the outer surface of the cylinder 12. The outer surface of this layer 18 is itself corrugated to define longitudinal grooves or channels 19 parallel to the axis of rotation of the cylinder 12 and equally spaced circumferentially around the drum 10. The grooves 19 are semi-circular in cross-section and about one inch in depth.

The drum 10 is driven for rotation by a petrol engine 20 mounted atop the frame 11, the cylinder 12 being coupled to the engine 20 by a reduction gear 21 and a chain drive 22. The right hand side of FIG. 1, as viewed in the drawing, constitutes the front of the apparatus and therefore the drum 10 is driven in the direction of the arrow 23. The apparatus is stabilised by a balance cylinder 24 carried by the frame 11 behind the drum 10, and the whole apparatus is manually guided by a handle 25 at the rear.

Inside the cylinder 12 each row of apertures 17 has an associated elongate rubber flap valve 26, as shown in FIGS. 6 and 7. Although the flap valves 26 are shown only in schematic form it is to be understood that in this embodiment they are attached at each end edge to the inner surface of the cylinder 12 and are so attached that each flap valve 26 is slightly stretched along its length, and each valve 26 is in this manner biassed to close the row of apertures 17 associated therewith. Such biassing is effected solely through the longitudinal tensioning of each flap valve and the closure of the apertures 17 is therefore maintained for all angular positions of the drum 10 (except when subject to inward water pressure as will be described). The flap valves 26 may be readily opened when water pressure is applied thereto and will readily close again once the action of water pressure thereon ceases. It is to be understood that, if desired, a single flap valve 26 could be used to close off two or more rows of apertures 17 rather than only a single row as described. Also, the flap valves could be spring-loaded or otherwise biassed in any conventional manner against the row of apertures 17. Furthermore, it is to be understood that the action of the flap valves in closing off the apertures 17 could be gravity-assisted, since it is only necessary that they be effective in the lower region of the drum 10 as will be described.

The inside of the cylinder 12 is also provided with a plurality of ducts or troughs 30, FIGS. 6 and 7, each trough extending parallel to the axis of rotation of the cylinder, and there being one such trough for each pair of adjacent rows of apertures 17 as shown in FIG. 6. Each trough 30 has an L-shaped cross-section with one longitudinal edge secured to the inner surface of the cylinder adjacent to a respective row of apertures 17, and the other (free) edge 31 being disposed inwardly of the inner surface of the cylinder and angularly displaced in the direction of rotation of the cylinder. The troughs 30 extend the full length of the cylinder 12 and are closed off at each end by the inside surfaces of the circular endwalls 32 (FIG. 3) of the cylinder. It will be recognised that an individual trough 30 could be provided for each row of apertures 17 if desired, rather than providing one trough for each two adjacent rows as in this embodiment.

The apparatus further includes a water tank 35 of part cylindrical cross-section, see FIGS. 3 and 4, the tank 35 being mounted on the shaft 13 by bearings 36. It will be understood that the tank 35 does not rotate with the drum 10. As will be described, the purpose of the tank 35 is to collect water which initially enters the apertures 17 from the foam rubber layer 18 in the area of contact with the ground and which is thereafter transported upwardly by the troughs 30. The tank 35 also collects water squeezed from the layer 18 by a pressure roller 36, FIGS. 1,2,5 and 6, the roller 36 being rotatably mounted between the opposite sides 15,16 of the frame 11 and being driven by the chain drive 22.

Referring to FIGS. 1 and 3 of the accompanying drawings the water which is collected in the tank 35 may be removed by a pump 45 mounted on the top of the frame 11. The pump 45 acts in a conventional manner to draw the water from the tank 35 through a discharge pipe 47 into the shaft 13 which is hollow, a rotary hose reel 46 being mounted on the frame 11 and operatively connected to a water outlet end (not shown) of the shaft 13.

Referring now in particular but not exclusively to FIG. 6, the apparatus operates as follows. When the engine 20 is running the drum 10 is rotated in the direction of the arrow 40 and is thus propelled forwardly in the direction of the arrow 41. In the area of ground contact 42 in front of a notional vertical centre plane intersecting the axis of the drum 10, the layer 18 is subject to increasing compression as the drum moves forward. In this area 42 the ground water 43 is first trapped in the grooves or channels 19 and, as the layer 18 compresses, the water is forced under pressure inwardly towards the cylinder 12 through the open cell structure of the layer 18. This inward pressure of the water in the progressively compressed layer 18 forces the flap valves 26 open in this area (see for example the valves 26'), and the ground water passes into the interior of the cylinder 12. When the valves 26 pass the notional vertical centre plane the adjacent foam rubber layer 18 now progressively decompresses so that the inward water pressure is relieved and the valves 26 close.

The water which entered the cylinder 12 is now trapped in the troughs 30 and is carried rearwardly and upwardly upon further rotation of the drum 10. At a certain height, depending upon the amount of water collected in each trough and the geometric dimensions of the apparatus, each trough will begin to discharge its water as shown for the trough 30' in FIG. 6. The opening at the top of the water tank 35 (not shown in FIG. 6) is sufficiently wide to collect this water as it drains from the troughs 30. It is of course to be understood that FIG. 6 has been considerably simplified, and that the apertures 17, flap valves 26 and troughs 30 are provided around the entire circumference of the cylinder 12 as hereinbefore described.

In addition to the ability of the apparatus as described above to collect bulk water in advance of the drum 10, another feature of the apparatus is that the open cell foam rubber 18 will effectively collect additional water and dry the grass to a considerable extent behind the drum as it rolls forward, since residual water and moisture is collected by the foam rubber 18 after it has passed the notional centre plane referred to above, i.e. after the point of maximum compression with the ground. This additional collection of water results from the fact that when the pressure on the foam rubber 18 is released, a strong suction is created as the cylinder apertures 17 are sealed off by the flap valves 26 thereby allowing the open cells of the foam rubber to suck in water. As the cylinder 12 rotates, the water in the foam rubber 18 is carried to the top of the cylinder when it is squeezed back through the flap valves 26 and the apertures 17 in the cylinder and into the central water tank 35. This is attained by means of the pressure roller 36 driven by the chain drive 22 to run against the foam rubber 18, applying a pre-determined pressure and effectively pressing the water out of the foam rubber, opening the flap valves 26, and dropping into the water tank 35 through the apertures 17 in the cylinder. It will be seen therefore that as the drum 10 further rotates past this pressure roller 36, the layer 18 will be cleared of all water. When the water in the tank 35 reaches a predetermined level, it is removed by the pump 45 (FIG. 2) mounted on top of the frame 11. The water is pumped out from the bottom of the tank 35 by means of the pipe 47, the hollow shaft 13 and the hose reel 46. The necessary length of say 1' water hose is carried on the rotary hose reel 46 (FIG. 1) mounted on top of the apparatus. This hose reel can be wound in or out as required, the hose of course being connected to the drain point nearest the area being cleared of water.

The apparatus can of course be adapted in design to carry a cab section with drivers seat. In the case of the hand guided apparatus shown in the drawings, however, the second smaller balancing cylinder 24 running behind the drum 10 is covered with high density closed cell foam rubber, PVC or other suitable material. This smaller guide cylinder does not carry any appreciable weight as its function is only as a balancing guide/steering roller.

Further benefits in this apparatus are gained by the fact that the foam rubber 18 will protect the ground from damage by the machine as the weight of the drum 10 and ancillary equipment is spread over a relatively flat area at the point of contact with the ground. This feature is vitally important in the case of football grounds, golf greens etc. where it would be impossible to allow any conventional machinery to traverse the ground in soggy conditions. The foam rubber 18 also effectively eliminates the effect of bumpy or uneven ground as, in the case of recesses, the rubber expands into them and in the case of protrusions or bumps, it will compress to the necessary degree. The spread of load on impression also benefits the carrying capacity of the apparatus as, in the case of the hand steered machined shown, the cylinder is capable of carrying the weight of the necessary equipment, i.e. engine, reduction gear, water pump, hose reel, etc. without risk of damage to the ground.

In fact the additional load of the engine, etc. is necessary to compress the foam to the extent of giving it the necessary downwards pressure on the ground, to force the trapped water into the cylinder 12.

A second embodiment of the invention will now be described with reference to FIGS. 9 and 10 of the accompanying drawings.

It is to be understood that in general the construction and operation of the water-removal apparatus of the second embodiment is the same as that described for the first embodiment. For this reason the description is restricted to the differences between the two, and the same reference numerals are used for similar elements.

Referring now to FIGS. 9, and 10, in the drum 10 of the present embodiment the longitudinal channels 19 of the first embodiment are replaced by individual apertures 50 which extend fully through the thickness of the layer 18 of open cell foam rubber, each aperture 50 being in register with and communicating directly with a respective aperture 17 in the cylinder 12. The apertures 50 are preferably in the form of funnels as shown, having a relatively large cup-like outer portion 51 at the outer surface of the layer 18 which tapers inwardly to a cylindrical inner portion 52 having a width substantially the same as that of the respective circular aperture 17 in the cylinder 12.

As before, the apertures 17 are arranged in staggered rows across the width of the cylinder 12, and the apertures 50 are therefore similarly located in the layer 18. However, since the cup-like portions 51 of the apertures 50 preferably have about the same width (2") at the outer surface of the layer 18 as the channels 19 previously provided, and since the apertures 50 correspond one-to-one to the apertures 17, the latter are somewhat larger and less in number than before. Thus the cylinder 12 has fewer rows of apertures 17 with fewer apertures in each row. For this reason, as shown in FIG. 2, only one row of apertures 17 and one flap valve 26 is provided between each adjacent pair of troughs 30.

The advantage of using the apertures 50 as compared to the channels 19 of the earlier drum is that the water trapped in the cup-like portions 51 by the advancing drum is pumped directly into the cylinder 12 by the compressive action of the ground on the layer 18, and does not have to be forced through intervening open-cell foam rubber.

Referring to FIGS. 11 and 12 of the accompanying drawings, a further embodiment of the invention provides a sheet of non-porous rubber 60 or the like non-porous material which is bonded in a conventional manner to the outer surface 61 of the open cell foam rubber layer 18, the rubber sheet 60 being provided with a plurality of apertures 62 which are in register with the apertures 50 in the open cell foam rubber layer 18. On a rubber layer 18 of 2 inch thickness, a rubber sheet 60 of 1/16 inch thickness is appropriate.

The rubber sheet 60 is sufficiently resilient to make it together with the foam rubber layer 18 a cover unit for the drum 10 which in use will retract under pressure to enhance the pumping action in front and at the bottom of the cylinder 12 as it traverses the ground and expands to suck up any residue of water through the apertures 17 at the rear of the rotating cylinder 12. The effect of the rubber sheet 60 covering is that, when the cylinder 12 rotates each row of apertures 50/62 traps the water as it rolls forward. The non-porous rubber sheet 60 forces the water to flow into the apertures 50/62 since the water under pressure will of course run to the area of least resistance, namely the nearest aperture 50/62 to each flat area of the open cell foam rubber layer 18. It will be seen therefore, that the addition of the rubber sheet bonded to the layer 18 diverts the flow of water to where it can be most efficiently pumped directly into the cylinder 12, in a greater volume than if the pumping was solely through the open cell foam layer 18. The non-porous rubber sheet 60 combined with the open cell foam layer 18 functioning as one unit, and the configuration of each funnel shape aperture 50/62 and the valve 26, provides an effective pump to draw water into the cylinder 12. There are, in effect, over 2,000 "pumps" on the drum 10 having a line contact with the ground of 50 in each row, each row preferably spaced 1" apart. A further advantage of the bonded rubber sheet surface covering is that it will protect the open cell foam layer 18 on the cylinder 12 from damage and wear, thereby prolonging the wearability of the entire cylinder covering. Because of the smooth surface which the rubber sheet covering imparts to the drum it greatly improves the turning facility of the machine in use, without any consequent damage to a grass covered ground.

It has also been found that the rubber sheet covering strengthens the open cell foam layer and enables it to carry a greater weight, while allowing the layer to flatten out at ground level to gain a substantial load and weight spread. This low compression has been found to be particularly important in relation to golf course greens for example where the maintenance of a smooth true ground surface is essential.

With regard to this last embodiment, since the use of the non-porous rubber sheet 60 directs the water under pressure more efficiently into the funnel shaped apertures 50/62 than in the case where the sheet 60 is absent, it is not necessary that the resilient foam rubber layer 18 be of open cell structure. Indeed, the sheet 60 prevents water from entering the body of the layer 18 except at the edges of the apertures 50/62, so that the amount of water absorbed in this way is much less than in the case where the sheet 60 is absent. Thus the pressure roller 36, FIG. 1, may also be omitted in this case.

Referring to FIGS. 13 and 14 of the accompanying drawings there is illustrated a fourth embodiment of the apparatus of the present invention. This embodiment provides for a fully motorised version of the apparatus and includes the provision of a base chassis 70 upon which four rollers 71,72,73 and 74 are provided in pairs both front and rear in a spaced-apart and side-by-side relationship. The chassis 70 also carries on support bars 70*a* a water tank 75 mounted intermediate the pairs of roller 71,72 and 73,74 and into which water collected in use by the pairs of rollers may drain as hereinafter described. The chassis 70 also carries a drivers seat 76, a conventional steering mechanism 77 operatively connected to the front pair of rollers 71,72, a drive motor 78 operatively connected by a chain drive (not shown) to the driven rear pair of rollers 73,74 a differential mechanism (not shown) mounted intermediate the ends of the drive shaft of the rear pair of rollers, and a pump 79 to discharge water from the water tank 75 through a pipe 79*a* to the pump 79 and then to a discharge nozzle 80.

The rollers 71,72,73,74 are each of a construction as described in relation to the earlier embodiments. The water collected by the rollers 71,72,73,74 in this embodiment drains under gravity from the collector tank in each roller through water feed pipes to the water tank 75. With the front rollers 71,72 the drainage is via the hollow shaft on which the rollers are mounted to the water feed pipe 81 connected between one end 82 of the hollow shaft and the water tank 75. Similarly the rear rollers 73,74 discharge the collected water to a water feed pipe 83 connected to the hollow drive shaft, at a point between the rollers, and the water tank 75. The water in the water tank 75 may be pumped away through a high velocity discharge nozzle 80 which will throw the water a distance from the ground being cleared of water or pass the water through a long hose line (not shown) which may be connected to the pump outlet to discharge the water away from the area being cleared of water. It is envisaged that this embodiment of the apparatus of the invention can when operating in water at a depth of 5cms lift and discharge 100 gals/-min.

I claim:

1. An apparatus for the removal of water from the ground, comprising: at least one ground-engaging drum including a hollow cylinder mounted for rotation about a horizontal axis, a plurality of apertures distributed around a circumference of the cylinder, and a layer of resilient material covering an outer surface of the cylinder, the resilient layer including means distributed around its circumference to permit the passage of water through the resilient layer to the cylinder, valve means in the drum arranged to close the apertures at least in respect of a lower region of the drum, except under an inward pressure of water passing through the resilient layer, a plurality of troughs on an inner surface of the cylinder for carrying water which enters the apertures in an area of ground contact upwardly away from the ground by rotation of the cylinder, and a non-rotating water tank mounted within the cylinder for collecting water discharged from the troughs when each trough reaches a certain height.

2. An apparatus as claimed in claim 1, wherein the resilient layer comprises open cell material, the open cells providing the said means which permit the passage of water through the layer.

3. An aparatus as claimed in claim 2, wherein an outer surface of the resilient layer of open cell material is corrugated to define longitudinal channels parallel to the axis of rotation of the cylinder.

4. An apparatus as claimed in claim 3, wherein each channel is arcuate in cross-section.

5. An apparatus as claimed in claim 1, wherein the means which permit the passage of water through the resilient layer comprises a plurality of apertures.

6. An apparatus as claimed in claim 5, wherein the apertures in the resilient layer are wider at the outer surface of the layer than at the inner surface where they communicate with the cylinder apertures.

7. An apparatus as claimed in claim 6, wherein the apertures are in the form of funnels.

8. An apparatus as claimed in claim 5 in which the apertures are each in register with and communicating directly with a respective aperture in the cylinder.

9. An apparatus as claimed in claim 5, 6, 7 or 8, wherein a sheet of non-porous rubber is provided on the outer surface of the resilient layer, the rubber sheet having apertures which are in register with the apertures in the resilient layer.

10. An apparatus as claimed in claim 1, wherein the apertures are arranged in rows across a width of the cylinder in parallel with the axis thereof, and wherein the valve means comprises a plurality of elongate flaps each associated with at least one row of apertures.

11. An apparatus as claimed in claim 10, wherein each aperture is in the form of a slot aligned in the direction of the respective row of apertures.

12. An apparatus as claimed in claim 10 or 11, wherein each trough extends parallel to the axis of the cylinder and has a first edge secured to the inner surface of the cylinder adjacent a respective row of apertures and a second free edge disposed inwardly of the inner surface of the cylinder and angularly displaced in the direction of rotation of the cylinder.

13. An apparatus as claimed in claim 12, wherein each trough has an L-shaped cross-section.

14. An apparatus as claimed in claim 1, further including a power source, and means coupling the power source to the drum to rotate the drum.

15. An apparatus as claimed in claim 1 comprising four ground engaging drums mounted in pairs to the front and rear of a chassis frame in side-by-side relationship, drive means operatively connected to at least one pair of drums, and a steering mechanism operatively connected to the front pair of drums.

16. An apparatus as claimed in claim 15, comprising a water tank mounted on the chassis frame between the front and rear pairs of rollers and gravity feed water pipe means connected between said rollers and the water tank.

* * * * *